9/28/82 OR 4,352,108

United States Patent [19]

Milne

[11] 4,352,108

[45] Sep. 28, 1982

[54] ANTENNA BEAM SHAPING STRUCTURE EMPLOYING DIPOLES ARRAYED ON A PARABOLIC SURFACE

[75] Inventor: Robert Milne, Ottawa, Canada

[73] Assignee: Her Majesty the Queen in right of Canada, as represented by the Minister of National Defence of Her Majesty's Canadian Government, Ottawa, Canada

[21] Appl. No.: 56,507

[22] Filed: Jul. 11, 1979

[30] Foreign Application Priority Data

Aug. 9, 1978 [CA] Canada ..... 309005

[51] Int. Cl.[3] ..... H01Q 19/12

[52] U.S. Cl. ..... 343/756; 343/840; 343/909

[58] Field of Search ..... 343/840, 754, 854, 909, 343/911 R

[56] References Cited

U.S. PATENT DOCUMENTS 3,755,815 8/1973 Stangel et al. ..... 343/754

4,070,678 1/1978 Smedes ..... 343/754

*Primary Examiner*—Eli Lieberman

*Attorney, Agent, or Firm*—Laff, Whitesel, Conte & Saret

[57] ABSTRACT

An omni-directional type passive antenna in which the response pattern is a close approach to the ideal of a hemisphere. The system includes an antenna having an antenna axis extending in the direction of highest antenna sensitivity, and a first surface which is a surface of revolution swept out by a part of a parabolic curve rotated about the antenna axis, the axis of the parabolic curve being inclined at an angle in the range of about 70 to 80 degrees to the antenna axis with the focus of the parabolic curve substantially on the antenna axis. A first set of electrically isolated dipoles is mounted on the surface and all are similarly oriented such that they lie only along edges of axial planes of the antenna. The system also includes a second surface which is a surface of revolution swept out by a part of a parabolic curve rotated about an antenna axis, the axis of the parabolic curve being inclined at a similar angle at the first surface, with the focus of the latter parabolic curve at the same position as the focus of the first surface. The second surface is spaced radially of the first surface with respect to the antenna axis. A second set of electrically isolated dipoles is mounted on the second surface and all are similarly oriented such that they lie only along edges of planes normal to the antenna axis. Preferably the second surface is spaced radially outwardly of the first surface.

19 Claims, 4 Drawing Figures

ANTENNA BEAM SHAPING STRUCTURE EMPLOYING DIPOLES ARRAYED ON A PARABOLIC SURFACE

BACKGROUND

This invention relates to improvements in antennas, and more particularly to antennas used as receiving antennas for space satellite signal transmissions.

Both the bearing and elevation of a space satellite relative to a receiving antenna is normally changing with time. Directional antennas have to be constantly moved in order to direct the antenna beam at the satellite. However, the present invention relates to a passive antenna which need not be moved in any way but relies instead on its response pattern to provide an acceptable output despite variations in elevation and bearing of the satellite.

Such an antenna ideally requires a circularly polarized hemispheric response pattern. Omni-directional type passive antennas have difficulty in achieving equal gain at all elevation angles because the projected receiving area of the antenna in the direction of the horizon is normally small.

An objective of the present invention is to provide a passive antenna arrangement in which the response pattern is a close approach to the ideal of a hemisphere.

SUMMARY OF THE INVENTION

In general, the inventive antenna beam shaping structure is comprised of a first surface which is a surface of revolution swept out by a part of a parabolic curve rotated about and being inclined at an angle in the range of about 70 to 80 degrees to the antenna axis with the focus of the parabolic curve substantially on the antenna axis, and a set of electrically isolated dipoles mounted on the surface and similarly oriented such that they lie along one of (i) edges of axial planes of the antenna, or (ii) edges of planes normal to the antenna axis.

More particularly, the invention is an antenna system including an antenna having an antenna axis extending in the direction of highest antenna sensitivity, and a first surface which is a surface of revolution swept out by a part of a parabolic curve rotated about the antenna axis, the axis of the parabolic curve being inclined at an angle in the range of about 70 to 80 degrees to the antenna axis with the focus of the parabolic curve substantially on the antenna axis. A first set of electrically isolated dipoles is mounted on the surface and all are similarly oriented such that they lie only along edges of axial planes of the antenna or alternatively along edges of planes normal to the antenna axis. In another embodiment the antenna system also is comprised of the first set of dipoles oriented so as to lie along edges of axial planes of the antenna, and also includes a second surface which is a surface of revolution swept out by a part of a parabolic curve rotated about an antenna axis, the axis of the parabolic curve being inclined at a similar angle as the first surface, with the focus of the latter parabolic curve at the same position as the focus of the first surface. The second surface is spaced radially of the first surface with respect to the antenna axis. A second set of electrically isolated dipoles is mounted on the second surface and all are similarly oriented such that they lie only along edges of planes normal to the antenna axis.

Preferably, the second surface is spaced radially outwardly of the first surface, although in some designs it may be spaced radially inwardly of the first surface.

INTRODUCTION TO THE DRAWINGS

The invention will now be described, by way of example, with reference to the accompanying drawings, in which.

Figure 1:
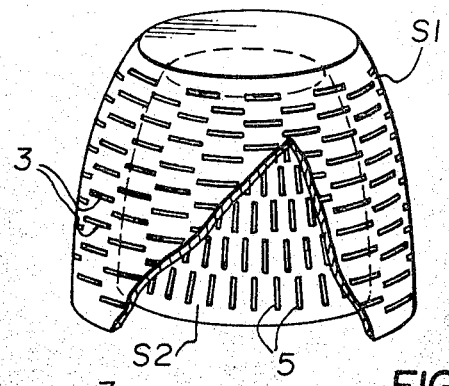
FIG. 1 is a partly cut away perspective drawing of a beam shaping structure for use in an antenna structure which has an omnidirectional response about a central axis.
Figure 3:
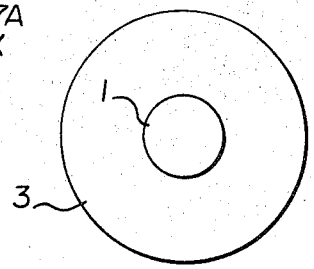
Figure 4:
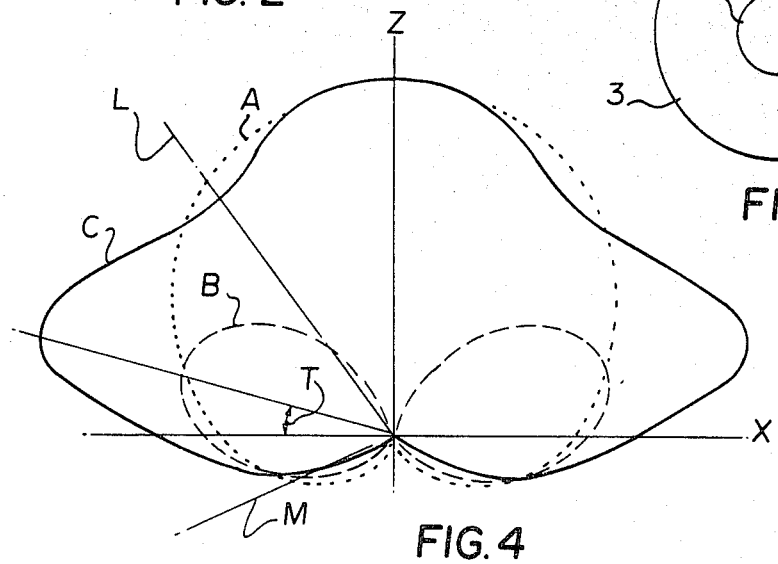

FIG. 3 is a plan view of a mounting plate for the beam shaping structure shown in FIG. 1; and FIG. 4 is a diagram showing as curve A the basic response curve which is symmetrical about a central axis (Z) of an antenna, showing as curve B the change in response effected by the beam shaping structure of FIG. 1, and showing as curve C the resulting response curve for the combination of antenna and beam shaping structure, again about the central axis (Z).

DESCRIPTION OF THE PREFERRED EMBODIMENT

In an operational system the Z axis would be the direction of the local vertical gravity vector and orthogonal axis X, a directional vector in the horizontal plane.

Figure 2:
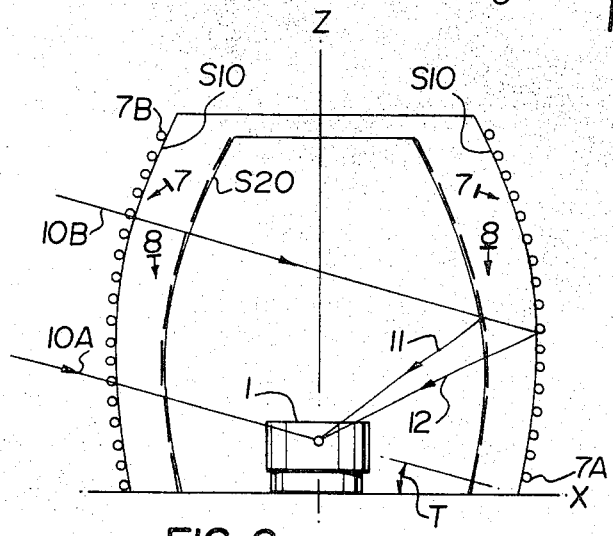
FIG. 2 is a diagrammatic cross section in a vertical plane of the beam shaping structure shown in FIG. 1.

Referring now to FIG. 1, shown is a partly cut away perspective drawing of a beam shaping structure in the form of an outer glass-fibre shell S1, the surface S10 of which (as shown in FIG. 2) is generated by the revolution about the central Z axis of part of a parabola with its axis inclined at an angle T to an X axis which is orthogonal to the Z axis. The focal point of this parabola lies on the Z axis. The surface S20 of an inner glass-fibre shell, S2, is similarly formed by the revolution about the Z axis of a second parabola with its axis inclined at angle T to the X axis. The focal point of the second parabola should coincide with that of the first parabola, on the Z axis. The phase centre of an antenna 1, is located at or near to the foci of the two parabolas on the Z axis. The shells S1 and S2 are preferably formed with a flange on their lower edge in order that they can be attached to a mounting plate such as the one shown in FIG. 3.

Adherently secured to the outer surface of the outer shell S1 is an array 7 of horizontal dipoles 3, (i.e. oriented such that they lie along edges of planes normal to the antenna axis) while adherently secured to the outer surface of shell S2 is an array 8 of "vertical" dipoles 5. It will be understood that "vertical" applies to the polarization of these dipoles, but in physical reality the upper dipoles in the array deviate appreciably from the true vertical. However, each of the "vertical" dipoles extends in an upwards direction at the edges of planes containing the Z axis.

The shells S1 and S1 alternatively can be of a suitable plastics material, but in any case they should be as transparent to radio waves as practical. If the shells were continued upwardly, each would terminate in a point on the Z axis, but in the example shown the top of the shells are truncated. If the shell is continued upwardly to a point, then the dipole arrays can terminate some distance from the top, for example at the level indicated in FIG. 1.

It is preferred that the diameter of the vertical dipole array, in a plane passing through the focus and orthogonal to the Z axis should be about 1.5 wavelengths, and the diameter of the horizontal dipole array in the same plane should be about 2 wavelengths.

The plate 3 should be conductive and this will serve as a ground plane of about 2.5 wavelengths in diameter, and as shown is under both of the arrays, and also functions as a base for antenna 1, in a plane orthogonal to the Z axis. In the embodiment shown, the axes of the parabolic sections are canted upwardly from the surface of the ground plane at about 15 degrees.

Antenna 1 in the embodiment shown is a cavity backed spiral type antenna.

Each of the dipole arrays 7 and 8 can be made using short copper strips which are stuck to the dielectric shells. It is important that the length/width ratio and the spacing/width ratio of the dipoles should be as large as possible.

In one prototype, the array 7 of horizontal dipoles on the surface S10, consisted of a matrix of 14 rows by 26 columns of dipoles. The even columns were displaced in the vertical from the odd columns by half the spacing between the rows. For operation at 1575 Mhz., in a given colunn of dipoles, the length of the dipoles varied from 1.8 inches in the bottom row 7A, to 1.5 inches in the top row 7B. The dipole width was 0.07 inches and the spacing between rows was about 0.6 inches.

The array 8 of vertical dipoles, on the surface S20, consisted of a matrix of 5 rows by 60 columns of dipoles. The even rows were displaced in the horizontal from odd rows by half the spacing between adjacent columns. For operation at 1575 Mhz., the length of each of the dipoles was 1.8 inches and the width of each was 0.07 inches, and the spacing between the columns of dipoles varies from about 0.59 inches in the bottom row, to about 0.45 inches in the top row.

The structure, in the prototype, had a height of 12 inches, a maximum diameter of 15 inches, and was mounted on an 18 inch diameter plate which served as a ground plane. The dielectric shells had a thickness of 0.07 inches, a dielectric constant of 2.2, and a specific gravity of 1.5.

Referring now to FIG. 2, shown in cross-section is the array of vertical dipoles 8 and the array of horizontal dipoles 7. The operation of the two arrays can be considered independently of one another for analysis purposes, with the outer array of horizontal dipoles reflecting the horizontal component of circularly polarized signal and with the inner array of "vertical" dipoles reflecting the vertical component of the circularly polarized signal.

It will be assumed that the incident wavefront directional vector makes the angle "T" with the horizontal plane. As the incident wavefront passes through the convex surfaces of the arrays 7 and 8 it induces currents in the dipoles, but experiences only a small phase shift and little or no attenuation. To achieve this condition, it is important that each of the dipoles should have a length of less than $\frac{1}{4}$ wavelength.

The incident signal is indicated as vectors 10A and 10B in FIG. 2. The antenna 1 receives vector 10A directly and reflected signals from the conave surfaces of the arrays (vectors 11 and 12). The reflected vertical component of the incident signal 10B is indicated as vector 11 and the reflected horizontal component is indicated as vector 12. By proper selection of the positions of the arrays the reflected signals are made to arrive in phase with and additive to the incident signal.

Antenna 1, which is located at the foci of the two parabolas, receives both the direct signal and the two reflected signals as described above. If the signals from all of the dipoles are to add in phase, the contour of each array in the elevation plane must follow the form of a parabola with its axis inclined at an angle "T" and with its focal point coinciding with the phase center of antenna 1. The difference in path lengths between the direct and reflected signal at this angle of incidence theoretically equals twice the focal length. In a successful prototype of the invention the inclination "T" of the axis of the parabolas was 15 degrees.

Considering either the vertically or horizontally polarized dipole arrays and a similarly polarized signal, most of the signal passes through the entire array, both at references S20 and at 11, for example. A very small portion is reflected from the array at both locations. Considering the shell S20 in crosssection, that which is reflected at the left side of S20 is scattered outwardly. That which is reflected at 11 is directed to the focus point, at which an antenna is to be located.

It is of course well understood that there is not only a single pencil beam of electromagnetic energy (10B) incident on the structure, but wavefronts which form a broad front. The energy which is reflected from the entire array S20 is scattered. The energy which is reflected from the other side of the same shell is focused to where the antenna is located. Consequently there is a concentration of each of the small amounts of reflected energy toward the focus of the array. The total amount of energy reflected is proportional to the reflected coefficient and the area of the array, i.e., is related to the product of the impinging energy and the area.

It should be kept in mind that most of the energy passes through the dipole array.

However, the added total of all the reflected energy at the antenna position is almost as large as the direct signal. Consequently the reflected energy at the antenna position which is in phase with the direct signal has been found to provide an approximately 6 db increase in signal output from the antenna.

To satisfy the in-phase condition for the vertical component of the circularly polarized incident signal.

$$2F = 1.50L,$$

where F equals the focal length of the parabolic surface S20 and,

L equals the wavelength of the incident signal.

To satisfy the in-phase condition for the horizontally polarized component of the circularly polarized incident signal $$2F = 2.00L,$$

where F equals the focal length of the parabolic surface S10, and

L equals the wavelength of the incident signal.

The above formulae, while being approximately accurate do not take into account the small phase shift between the direct and reflected signals introduced by the presence of the dielectric shells, or edge effects, etc.

The reflection coefficient of each array of dipoles appears to be a function of the dipole length L, the dipole width W, and the separation between the dipoles S. To achieve a high level of polarization discrimination by the arrays, it is important that the ratios L/W and S/W are as large as possible.

The gain of the parabolic arrays appears to be directly proportional to the reflection coefficient of the arrays and the effective area of the array over which the incident wave is planar.

The effective beam width of the array in the elevation plane is given by $$t=KL/h$$

where t is the beam width in radians.

K is a constant

L is the wavelength, and h is the effective height of the array.

It appears that the effective height of the array is related almost directly to its physical height, ie. from the ground plane to the uppermost dipole.

In FIG. 4, as an aid to the visualization of the antenna beam shaping process, the antenna pattern of the two dipole arrays 7 and 8 of the present invention has been superimposed as curve B on the reception pattern curve A of an antenna with a cardioid response. The combined response is given by response curve C, as the sum of curves A and B. The height of the array also determines the effective area of the array. The length, width and spacing of the dipole elements are chosen to obtain the required reflection coefficient.

In the embodiment shown, the gain was maximized at the elevation angle T. From the above, it will be noted that the effective area of the two arrays and the reflection coefficient determine the gain of the arrays. It will be seen that there is a substantial improvement in gain in an angular region around elevation angle T, at the expense of a relatively small loss in gain over a region at a higher elevation (circa 45 degrees) where the gain of the antenna is in any case relatively high.

At angles greater than angle T, the reflected signal leads the direct signal in phase. For angles less than angle T, the reflected signal lags the direct signal.

At certain angles (see incident rays L and M) the direct signal and reflected signal will be received by antenna 2 in antiphase. Also, the reflected signals will be attenuated because of the directivity of the array pattern.

The gain of the array decreases for angles greater than T. At the angle of incident ray L the relative differences in gains between the cardioid antenna pattern and the array pattern will be appreciable and consequently the composite reduction in gain will be relatively small.

The cardioid pattern of the antenna 1 shows a gain which decreases as the incident angle decreases. The gain of the array also decreases for angles less than T. At the angle of incident ray M the gains of the antenna and the array are comparable, thus resulting in a large reduction in gain in the composite antenna pattern.

In summary, by choosing a suitable inclination angle T, an effective array height, and dipole parameters L, W, and S, a significant improvement in overall gain can be achieved at elevations in the region of angle T. Appreciable improvement in antenna sidelobe level also appears to be realized. These improvements are achieved at the expense of a relatively small loss in gain over a region where the gain of the cardioid response antenna is relatively high, i.e. at large angles from the horizontal axis.

A consideration of FIG. 4 shows that there is a substantial increase in gain at low angles where the cardioid response of the antenna is poor relative to its high-angle response.

At the elevation angle T, the direct and reflected signals are in phase. If the frequency of operation is increased, the reflected signal lags the direct signal. Conversely, if the frequency is decreased, the reflected signal leads the direct signal. As there is a change in phase between the direct and reflected signal, clearly there is a loss of gain at the angle T. If the direct and reflected signals are equal in magnitude, it can be calculated that a 40 degree relative phase change corresponding to a 5% change in frequency over 2.00L (where L is the wavelength) results in a loss of gain of 1 db at elevation angle T.

With the dipoles less than $\frac{1}{4}$ wavelength in length at the highest frequency of operation, there will be relatively little change in phase as the frequency is changed. The amplitude of the reflection coefficient of the dipoles increases with frequency and must be taken into account when calculating gain during the antenna design phase.

In respect of bandwidth, each shaped beam antenna will have a different bandwidth depending on its gain and sidelobe requirements.

In a prototype fabricated according to the dimensions described in the disclosure, and operating at 1575 MHz, the antenna achieved a 5% instantaneous bandwidth. A circularly polarized gain greater than 0 dbi between 0 degrees and 80 degrees, i.e. at 10 degrees above the horizon, was measured, with a gain slope of 0.5 dB/degree in the vicinity of the horizon, a sidelobe level of less than −18 dbi between 130 degrees and 180 degrees, and an ellipticity ratio of less than 5 dB between 0 degrees and 90 degrees, where 0 degrees is the elevation angle at local zenith and 90 degrees in the elevation angle at the horizon.

It should be understood that while an antenna beam shaping structure utilizing both vertical and horizontal dipole arrays have been described for receiving circularly polarized signals, either the vertical or horizontal dipole array described can be used by itself to shape the reception pattern for vertically or horizontally polarized signals respectively.

A person skilled in the art understanding this invention may now conceive of variations, modifications and other embodiments, using the principles of this invention. All are considered within the sphere and scope thereof as defined by the appended claims.

I claim:

1. An antenna beam shaping structure for receiving broadcast radio frequency energy from an earth satellite or other moving body whose bearing and elevation relative to the structure are subject to variation with time, comprising:

(a) a first surface which is a surface of revolution swept out by a part of a parabolic curve rotated about an antenna axis, the axis of the parabolic curve being inclined at an angle in the range of about 70 to 80 degrees to the antenna axis with the focus of the parabolic curve substantially on the antenna axis, and (b) a set of electrically isolated dipoles mounted on said surface and similarly oriented such that they lie along the edges of axial planes of said antenna.

2. An antenna beam shaping structure for receiving broadcast radio frequency energy from an earth satellite or other moving body whose bearing and elevation relative to the structure are subject to variation with time, comprising:

(a) a first surface which is a surface of revolution swept out by a part of a parabolic curve rotated about an antenna axis, the axis of the parabolic curve being inclined at an angle in the range of about 70 to 80 degrees to the antenna axis with the focus of the parabolic curve substantially on the antenna axis, (b) a first set of electrically isolated dipoles mounted on said surface and being similarly oriented so that they lie only along edges of axial planes of said antenna, (c) a second surface which is a surface of revolution swept out by a part of a parabolic curve rotated about an antenna axis, the axis of the parabolic curve being inclined at an angle in the range of about 70 to 80 degrees to the antenna axis with the focus of the parabolic curve substantially on the antenna axis, the second surface being spaced radially of the first surface with respect to the antenna axis, and (d) a second set of electrically isolated dipoles mounted on the second surface and being similarly oriented such that they lie only along edges of planes normal to the antenna axis.

3. An antenna system for receiving broadcast radio frequency energy from an earth satellite or other moving body whose bearing and elevation relative to the structure are subject to variation with time, including:

(a) an antenna having an antenna axis extending in the direction of highest antenna sensitivity, (b) a first surface which is a surface of revolution swept out by a part of a parabolic curve rotated about an antenna axis, the axis of the parabolic curve being inclined at an angle in the range of 70 to 80 degrees to the antenna axis with the focus of the parabolic curve substantially on the antenna axis, and (c) a set of electrically isolated dipoles mounted on said surface and similarly oriented such that they lie along the edges of axial planes of said antenna.

4. An antenna system for receiving broadcast radio frequency energy from an earth satellite or other moving body whose bearing and elevation relative to the structure are subject to variation with time, including:

(a) an antenna having an antenna axis extending in the direction of highest antenna sensitivity, (b) a first surface which is a surface of revolution swept out by a part of a parabolic curve rotated about an antenna axis, the axis of the parabolic curve being inclined at an angle in the range of about 70 to 80 degrees to the antenna axis with the focus of the parabolic curve substantially on the antenna axis, (c) a first set of electrically isolated dipoles mounted on said surface and being similarly oriented such that they lie only along edges of axial planes of said antenna, (d) a second surface which is a surface of revolution swept out by a part of a parabolic curve rotated about an antenna axis, the axis of the parabolic curve being inclined at an angle in the range of about 70 to 80 degrees to the antenna axis with the focus of the parabolic curve substantially on the antenna axis, (e) a second set of electrically isolated dipoles mounted on the second surface and being similarly oriented such that they lie only along edges of planes normal to the antenna axis.

5. An antenna beam shaping structure for receiving broadcast radio frequency energy from an earth satellite or other moving body whose bearing and elevation relative to the structure are subject to variation with time, comprising:

(a) a first surface which is a surface of revolution swept out by a part of a parabolic curve rotated about an antenna axis, the axis of the parabolic curve being inclined at an angle in the range of about 70 to 80 degrees to the antenna axis with the focus of the parabolic curve substantially on the antenna axis, and (b) a set of electrically isolated dipoles mounted on said surface and similarly oriented such that they lie along the edges of planes normal to the antenna axis.

6. An antenna system for receiving broadcast radio frequency energy from an earth satellite or other moving body whose bearing and elevation relative to the structure are subject to variation with time, including:

(a) an antenna having an antenna axis extending in the direction of highest antenna sensitivity, (b) a first surface which is a surface of revolution swept out by a part of a parabolic curve rotated about an antenna axis, the axis of the parabolic curve being inclined at an angle in the range of 70 to 80 degrees to the antenna axis with the focus of the parabolic curve substantially on the antenna axis, and (c) a set of electrically isolated dipoles mounted on said surface and similarly oriented such that they lie along the edges of planes normal to the antenna axis.

7. An antenna beam shaping structure as defined in claim 1, 2 or 5 in which the dipoles are evenly distributed about the antenna axis.

8. An antenna beam shaping structure as defined in claim 2 in which the second surface is spaced radially outwardly of the first surface.

9. An antenna system as defined in claim 4 in which the second surface is spaced radially outwardly of the first surface.

10. An antenna system as defined in claim 7, 8 or 4 in which the dipoles are evenly distributed about the antenna axis.

11. An antenna system as defined in claim 9 in which the antenna has a cardioid response pattern.

12. An antenna beam shaping structure as defined in claim 2, in which the diameter of the first set of dipoles in a plane orthogonal to the central axis at said focus is about $1\frac{1}{2}$ wavelengths, and the diameter of the second set of dipoles in the same plane is about 2 wavelengths.

13. An antenna beam shaping structure as defined in claim 12, in which the focal length of the parabola defining the first surface is 1.50L/2 and focal length of the parabola defining the second surface is about 2.00L/2, where L is the wavelength.

14. An antenna beam shaping structure as defined in claim 2, 12 or 13, in which each of the dipoles is less than $\frac{1}{4}$ wavelength in length at the highest frequency of operation.

15. An antenna beam shaping structure as defined in claim 2, 12 or 13, in which each of the dipoles is less than $\frac{1}{4}$ wavelength in length, the width of each of the dipoles is very much smaller than the length, and the separation between the dipoles is very much larger than the width of each of the dipoles.

16. An antenna beam shaping structure as defined in claim 2, 12 or 13, in which each of the dipoles is less than $\frac{1}{4}$ wavelength in length at the highest frequency of operation, the width of each of the dipoles is very much smaller than the length, and the height of the array is about $1\frac{3}{4}$ wavelengths.

17. An antenna beam shaping structure as defined in claim 2, 12 or 13, in which the length of each of the dipoles is less than $\frac{1}{4}$ wavelength at the highest frequency of operation, the width of each of the dipoles is very much smaller than the length, and further including a ground plane underlying said arrays below the foci of the parabolas orthogonal to the axis, the ground plane being coaxial with said antenna axis.

18. An antenna beam shaping structure as defined in claim 2, in which each of the arrays of dipoles is supported by a thin-walled dielectric shell transparent to electromagnetic energy.

19. An antenna beam shaping structure as defined in claim 2 or 18, in which the spacing of the vertical and horizontal dipole arrays from each other and from their mutual vertical axis and focus is predetermined such as to cause the incident signal passing through one wall of each of said arrays and the signal reflected from the other wall of each of said arrays to be in phase at said focus.

* * * * *